United States Patent [19]

Wiedmer

[11] 4,090,630

[45] May 23, 1978

[54] CONTAINER CLOSURE

[75] Inventor: Walter Wiedmer, Nafels, Switzerland

[73] Assignee: Walter Wiedmer Plastikform, Switzerland

[21] Appl. No.: 755,726

[22] Filed: Dec. 30, 1976

[30] Foreign Application Priority Data

Feb. 16, 1976 Switzerland ..... 1873/76

[51] Int. Cl.[2] ..... B65D 41/16; B65D 41/18; B65D 41/46

[52] U.S. Cl. ..... 215/320; 215/354; 215/355

[58] Field of Search ..... 215/320, 211, 354, 355, 215/341, DIG. 1; 220/DIG. 19

[56] References Cited

U.S. PATENT DOCUMENTS 3,074,579 1/1963 Miller ..... 215/354 X
3,572,413 3/1971 Livingstone ..... 215/354 X
3,979,004 9/1976 Bertario ..... 215/341

*Primary Examiner*—George T. Hall
*Attorney, Agent, or Firm*—McGlew and Tuttle

[57] ABSTRACT

A container closure, comprises a container having an open mouth, with a rim formation around the mouth with an exterior bead formation and an interior wall. The container is closed by a cap which has a flat top portion overlying the mouth and it has an annular skirt portion extending downwardly from the periphery of the flat top portion, which is engaged over the bead formation and terminates at its lower internal end in a bead engaged against the interior surface of the container below the bead formation. The cap also has a substantially cylindrical central part with an annular portion bearing against the interior wall of the receptacle adjacent the rim which has a lower free end with a reinforcing portion.

6 Claims, 4 Drawing Figures

CONTAINER CLOSURE

FIELD AND BACKGROUND OF THE INVENTION

This invention relates in general to the construction of containers and closures therefor and, in particular, to a new and useful container closure which includes an outer cap portion embracing the rim of the receptacle or container and a central portion which depends from a flat top surface which engages into the interior of the receptacle.

DESCRIPTION OF THE PRIOR ART

Closures of the prior art are fitted on a receptacle mouth either manually, or in the case of filling stations, by mechanical pressure, or if screw caps are used, by screwing. In closures to be put in place by pressure, the cap portion, or so-called snap cap, becomes somewhat enlarged and then snaps over the mouth rim of the receptacle. The central portion which projects into the interior of the receptacle or container may be of various design.

In one of the known designs, the central portion extends from the top of the cap portion into the interior of the receptacle and is terminated, on its lower end, by a disc. Consequently, viewed from above, for example, in an engaged position, such a closure forms a cavity. This is undesirable in many instances, partly because dirt or liquid may accumulate in the cavity, for example, water of condensation or rain water which accumulates during transportation, or liquid from damaged bottles, and also because no advertising imprints can be provided. In such cases, closures are preferred which have a completely flat cap portion on the outside.

A flat cap portion has the disadvantage, however, that the central portion, which must provide a first sealing in the neck of the receptacle, must be finished with particular care and it must also have mechanical resistance. That is, the mechanical fixing of snap caps of this kind, which takes place at high speeds, produces considerable pressures, particularly, if the position of the receptacle is slightly inclined. These pressures may result in a compression of the central portions which are not sufficiently resistant, i.e., their free end is pressed inwardly or turned inside out at one location, and this considerably impairs or even negates the sealing effect. This drawback could be avoided by designing the central portion as a solid body. However, and mostly for reasons of saving material and for manufacturing convenience, the central portion is designed as a ring which projects downwardly from the cap portion which may take various cross-sectional shapes, depending on the purpose thereof. Since the predominant reason is for the sake of manufacturing convenience, primarily in view of the jet mold, in most cases, the free end of the ring is designed so that either the wall thickness of the ring remains constant over its entire height, or the largest thickness of the wall is provided approximately midway of its height, i.e., at the location where the central portion applies sealingly and under pressure against the inside of the receptacle neck, and then diminishes toward the free end. This design, however, increases the risk of a compression or turning inside out of the central portion, since the free end is relatively weak.

In screw caps having a flat cap portion, a design of the central portion in the shape of only a ring is also unsatisfactory in many instances. It is true that here, because of the rotation of the closure during screwing on, the risk of a compression or turning inside out is absent. On the other hand, huge manufacturing tolerances of the receptacle neck are to be taken into account for such closures, particularly for beverage bottles, depending on their use. The inside surface of the receptacle neck is frequently funnel-shaped instead of cylindrical and the cross-section is often non-circular, or both anomalies may occur conjointly, as well as still further ones. Even in such cases, therefore, it is essential to ensure that the central portion applies all around strongly against the inside wall, in accordance with its function as the first sealing point. With a central portion designed only as a ring, however, the free end no longer complies with this requirement, since it is rather amply spaced from the other end because of the flat surface of the cap portion. In consequence, here again, the relatively weak end must be correspondingly reinforced.

SUMMARY OF THE INVENTION

The purpose of the present invention is to eliminate the above-mentioned drawback. To this end and in accordance with the invention, the central portion of the closure is designed so that the free end of its portion intended for engaging the inside of the receptacle, is provided with a reinforcing portion.

Accordingly, it is an object of the invention to provide a container closure which comprises a container having an open mouth with a rim formation around the mouth which has an exterior bead formation and a substantially straight interior wall, and including a cap which has a flat top which overlies the mouth and an annular skirt portion which extends downwardly from the periphery of the flat top portion and engages with an inwardly directed bead over the bead formation and, wherein, the cap also includes a substantially cylindrical central part with an annular portion bearing against the interior wall of the receptacle adjacent the rim and with an lower free end thereof with a reinforcing portion extending substantially radially inwardly from the container interior wall.

A further object of the invention is to provide a container closure which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

DETAILED DESCRIPTION OF THE PREFERRED EMBODIMENTS

Figure 1:
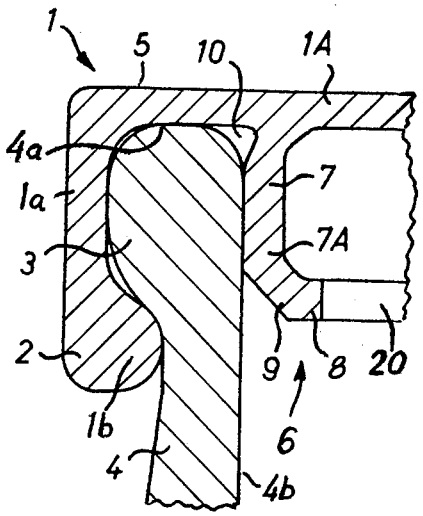
FIG. 1 is a partial vertical sectional view of a container closure constructed in accordance with the invention.

Referring to the drawings in particular, the invention embodied therein in FIG. 1, comprises a closure for a container or receptacle 4, which includes a rim portion **4*a* with an exterior beaded formation 3 and an interior wall 4*b***.

In accordance with the invention, the closure includes a cap, generally designated 1, for the receptacle 4, which has a flat top surface 5 and an annular skirt portion 1*a* which has a lower free end with an inwardly directed bead 1*b* which engages over the beaded formation 3.

In accordance with the invention, the cap 1 includes a substantially cylindrical central part, generally designated 6, having an annular portion 7 which bears against the interior wall 4*b* and which has a lower free end 7A which is reinforced as by a radially inwardly extending frusto conical portion 9 and a straight portion 8. The lower interior portion of the central part 6 is provided with an opening or slot 20. The portion 7 applies against the interior wall 4*b* and provides a first sealing of the receptacle and a second sealing is formed by the cap 1 by the bead formation 3 and the bead 2.

Should the central part 6 comprise only the annular portion 7 without the free end 7A, as is provided in the prior art, it would happen that while attaching the closure in an oblique position, the free end 7A would abut against mouth 3 instead of slipping therealong and moving into the interior of the receptacle or container 4. This would result in a compression or turning inside out of this portion at least at the respective location because the free end 7A would not be able to resist the impact. In order to reinforce this end, a further portion 8 is provided which may directly follow the portion 7 or be added in with a reinforcing portion which includes a frusto conical part 9. Portions 8 and 9 extend obliquely in respect to the longitudinal axis of the container and cap, and in effect, forms an angled rim of the portion 7. The reinforcing portion 8 may comprise an apertured disc for purposes of manufacturing, but it is never a solid disc. Portion 8 acts as a reinforcement absorbing forces which are unilaterally directed either against portion 8 or against portion 7 and distributes these forces along its circumference. In the manufacture thereof, no difficulties will arise with portion 8 while ejecting the closure from a mold in the upward direction, since the material of the closure is resilient and portion 8 can expand and slide over the mold without being damaged. The only requirement is that the ejection pressure may have to be increased.

Figure 2:
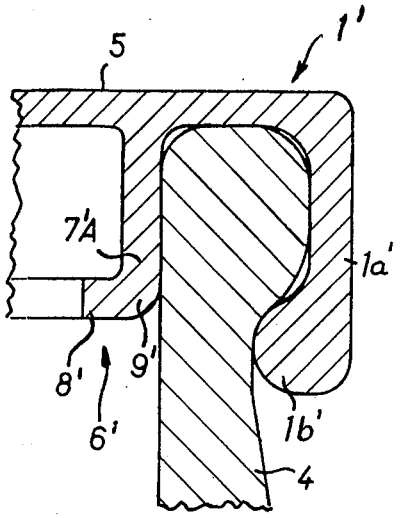
FIGS. 2 through 4 are views, similar to FIG. 1, of other embodiments of the invention.
Figure 3:
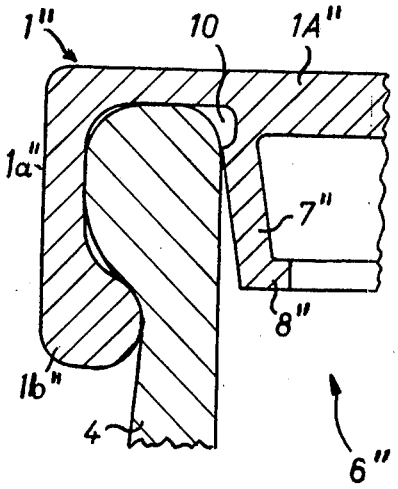
Figure 4:
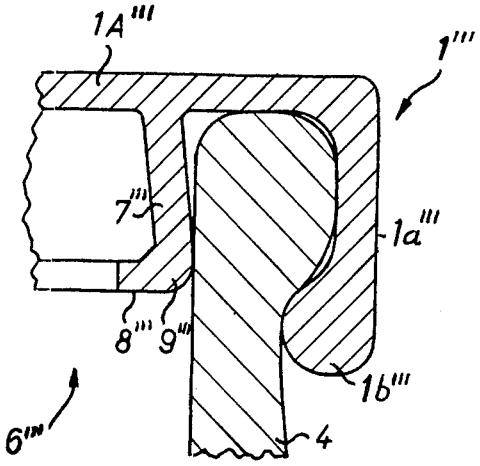

The other FIGS. 2, 3 and 4 show various modifications of closures in which caps 1', 1'' and 1''' are shown. In FIG. 2, the intermediate portion 9' is rounded into a flat portion 8'.

In the embodiment of FIG. 3, cap 1'' includes a central part 6'' which is made up of an annular frusto conical portion 7'' which is joined directly to a radially inwardly extending reinforcement portion 8''.

In the embodiment of FIG. 4, a cap 1''' includes a central portion 6''' in which a frusto conical portion 7''' connects through an intermediate reinforcing part 9''' to a flat reinforcing part which extends radially inwardly 8'''. The appropriate design depends on the receptacles to be closed since their manufacturing standards and tolerances vary from country to country and frequently also from manufacturer to manufacturer. For narrow ranges of tolerances, the designs according to FIGS. 1 and 2 are satisfactory, while for very large ranges of tolerances, the design of either FIG. 3 for particularly narrow receptacles, or FIG. 4 for particularly wide receptacles, is preferable.

A design of the closure as a screw cap does not change the construction in respect to the central part 6. Only the cap 1 is designed differently and it would not include a bulged rim 2 but would be approximately cylindrical in the vertical portion and provided with an internal thread which cooperates with an external thread of the receptacle neck.

It is advantageous if the central part 6 which absorbs the impact forces exerted on reinforcing rim 8 during the closing operation, as well as the radial pressure forces which occur after the closure, is put in place and exerted by the mouth of the receptacle, is joined to a portion 1A of the cap part 1 in a manner such that as small as possible stress peaks are introduced into the transition zone between portion 7 and portion 1A of the flat top 5. To this end, as shown in FIGS. 1 and 3, a groove 10 may be provided having only a small depth and a considerable width relative to the depth. The decision of whether or not such a groove 10 is to be provided on the use, that is, for what receptacles the closure is intended, and which manufacturing standards and tolerances of those receptacles are determining, since the differences may influence the stress peaks occurring in the transition zone.

In the design of FIG. 4, the groove 10 is unnecessary since no radial pressure forces can occur in the transition zone between the part 7''' and the portion 1A. Here, the radial forces are exerted on central part 6 further below where they can be absorbed partly by portion 7''' and partly by the reinforcing rim 8'''.

While specific embodiments of the invention have been shown and described in detail to illustrate the application of the principles of the invention, it will be understood that the invention may be embodied otherwise without departing from such principles.

What is claimed is:

1. A container closure, comprising a container having an open mouth, a rim formation around the mouth having an exterior bead formation and an interior wall, a cap having a flat top portion overlying the mouth and having an annular skirt portion extending downwardly from the periphery of said flat top portion and engaged over said bead formation and having a lower internal bead engaged against the exterior of said container below said bead formation, said cap having a substantially cylindrical central part depending from the interior of said flat top and bearing against said interior wall of said receptacle adjacent said rim, said cylindrical portion having a lower free end with a reinforcing portion parallel to said flat top portion extending radially inwardly from said container interior wall but being opened centrally on the interior of said cylindrical central part from said reinforcing portion substantially to said flat top portions.

2. A container closure, according to claim 1, wherein said reinforcing portion includes an inwardly directed frusto conical part and a flat inwardly extending radial part.

3. A container closure, according to claim 1, wherein said reinforcing portion includes a flat part extending inwardly from the lower free end of an annular central part.

4. A container closure, according to claim 1, including a groove formed between said central part and the interior of said cap.

5. A container closure, according to claim 1, wherein said central part is frusto conical.

6. A container closure, according to claim 1, wherein said central part extends obliquely from said cap radially inwardly and downwardly.

* * * * *